US009933236B2

(12) United States Patent
Kelly

(10) Patent No.: US 9,933,236 B2
(45) Date of Patent: Apr. 3, 2018

(54) ARCHERY SIGHT HAVING A BIASING MEMBER OPERABLE IN ADJUSTMENT MODE

(71) Applicant: Scott Archery, LLC, Clay City, KY (US)

(72) Inventor: Daniel N. Kelly, Rochester, NY (US)

(73) Assignee: Scott Archery LLC, Clay City, KY (US)

( * ) Notice: Subject to any disclaimer, the term of this patent is extended or adjusted under 35 U.S.C. 154(b) by 67 days.

(21) Appl. No.: 15/167,057

(22) Filed: May 27, 2016

(65) Prior Publication Data

US 2016/0349010 A1 Dec. 1, 2016

Related U.S. Application Data

(60) Provisional application No. 62/167,087, filed on May 27, 2015.

(51) Int. Cl.
*F41G 1/467* (2006.01)
*F41G 11/00* (2006.01)

(52) U.S. Cl.
CPC ..... *F41G 1/467* (2013.01); *F41G 11/00* (2013.01)

(58) Field of Classification Search
CPC ..... F41G 1/467; F41G 11/00
USPC ..... 33/265; 124/87
See application file for complete search history.

(56) References Cited

U.S. PATENT DOCUMENTS 3,871,105 A 3/1975 Brougham
4,543,728 A 10/1985 Kowalski
4,819,611 A 4/1989 Sappington
5,040,300 A 8/1991 Sheffield
5,228,204 A 7/1993 Khoshnood
5,419,051 A 5/1995 Barngrover
8,713,807 B2 * 5/2014 LoRocco ..... F41G 1/345 124/87
2003/0056379 A1 * 3/2003 Johnson ..... F41G 1/467 33/265
2004/0107587 A1 * 6/2004 Floied ..... F41G 1/467 33/265
2005/0138824 A1 * 6/2005 Afshari ..... F41G 1/467 33/265
2005/0246909 A1 * 11/2005 Rager ..... F41G 1/467 33/265

OTHER PUBLICATIONS

TRUGLO TSX Webpages; on or before Apr. 1, 2014; retrieved from the Internet: http://www.truglo.com/pc_product_detail.asp?key=A7C319733FFB48E887D40E0CF3F6A6D8&catid=; 8 pages.
Dave Dolbee; "Range Report: TRUGLO TSX Pro Series 5-pin"; Archery, General, Range Reports; Jul. 8, 2013; retrieved from the Internet: < http://blog.cheaperthandirt.com/range-report-truglo-tsx-pro-series-5-pin/>; 3 pages.

* cited by examiner

*Primary Examiner* — R. A. Smith
*Assistant Examiner* — Tania Courson
(74) *Attorney, Agent, or Firm* — Barclay Damon LLP

(57) ABSTRACT

A bow sight is described herein. The bow sight includes, in an embodiment, a frame configured to be coupled to an archery bow. The frame defines or includes a track or slot which extends vertically. At least one sight pin is coupled to frame and is movable between a plurality of vertical positions. At least one biasing member is coupled to the sight pin. The biasing member maintains the sight pin in a selected position to facilitate adjustment of the sight pin.

20 Claims, 17 Drawing Sheets

ARCHERY SIGHT HAVING A BIASING MEMBER OPERABLE IN ADJUSTMENT MODE

CROSS-REFERENCE TO RELATED APPLICATION

This application is a non-provisional of, and claims the benefit and priority of, U.S. Provisional Patent Application No. 62/167,087, filed on May 27, 2015. The entire contents of such application are hereby incorporated by reference.

BACKGROUND

An archery sight can be coupled to an archery bow to facilitate archery accuracy. For example, the sight can be used for aiming the archery bow. There are front sights, and there are rear sights known as peep sights. The archer aligns the peep sight with the front sight to aim the archery bow.

The known front sight has adjustable pins within the front sight. Each pin can be placed at a particular position within the sight that corresponds to a particular shooting distance. When aiming the archery bow, the archer aligns the peep sight with the desired pin of the front sight that corresponds to the desired distance for hitting a target. The pins can be repositioned by the archer to correspond to an archer's chosen distance. However, when the sight pins are loosened for repositioning, the sight pins are subject to the effects of gravity and tend to quickly slide and drop out of position. This tendency makes fine adjustments of the sight pins difficult to achieve. This difficulty in adjusting the sight pins can result in aiming problems and shooting inaccuracy.

The foregoing background describes some, but not necessarily all, of the problems, disadvantages, and shortcomings related to bow sights.

SUMMARY

In an embodiment, the bow sight includes: (a) a frame configured to be coupled to an archery bow, wherein the frame defines a slot configured to extend vertically when the frame is coupled to the archery bow and when the archer bow is vertically oriented; and (b) at least one sight pin having: (i) a weight; (ii) a mount portion configured to be at least partially inserted into the slot; and (iii) a tip portion. The mount portion is configured to be adjustable between a plurality of vertical positions within the slot. The bow sight also includes at least one coupler configured to couple the mount portion to the frame, wherein the at least one coupler is configured to be adjusted between: (a) a secure mode in which the mount portion is secured in one of the vertical positions; and (b) a loose mode in which the weight of the at least one sight pin is sufficient to move the mount portion to another one of the vertical positions. Also, the bow sight includes a biasing member configured to be coupled to the coupler portion, wherein the biasing member is configured to counteract the weight of the sight pin to maintain the sight pin in one of the vertical positions when the at least one coupler is in the loose mode.

In another embodiment, the bow sight includes: (a) a sight frame having at least one pin mounting surface extending vertically when the sight frame is coupled to an archery bow which is oriented held vertically, wherein the at least one mounting surface has at least one track extending vertically when the sight frame is coupled to the archery bow oriented vertically; and (b) at least one sight pin configured to be coupled to the at least one track and movable between a plurality of vertical positions relative to the at least one track, wherein the at least one sight pin includes: (i) a weight; (ii) a sighting end; (iii) a fastening end configured to be adjustably coupled to the at least one track; and (iv) a pin body extending between the sighting end and the fastening end.

Also, the bow sight includes: (a) a pin fastener configured to fasten the fastening end to the at least one track; and (b) a biasing member configured to be coupled to the at least one sight pin. The biasing member is configured to generate a force to maintain the at least one sight pin in a first one of the vertical positions when the at least one fastener has been loosened. The force is sufficient to maintain the first position until the at least one sight pin is subject to another force in addition to the weight of the at least one sight pin.

In yet another embodiment, the bow sight includes a sight frame configured to be coupled to an archery bow. The sight frame has at least one pin mounting surface. The sight frame defines first and second slots, wherein each of the first and second slots extends vertically when the sight frame is coupled to an archery bow which is vertically oriented. The bow sight also includes a first sight pin configured to be coupled to the sight frame, wherein the first sight pin is moveable between a plurality of first vertical positions relative to the first slot. The first sight pin is associated with a first shooting distance. The first sight pin has a first weight and a first insert configured to be inserted into the first slot. The first insert extends along a first axis.

Also, the bow sight includes a second sight pin configured to be coupled to the sight frame. The second sight pin is moveable between a plurality of second vertical positions relative to the second slot. The second sight pin is associated with a second shooting distance which is different from the first shooting distance. The second sight pin has a second weight and a second insert configured to be inserted into the second slot. The second insert extends along a second axis.

In addition, the bow sight includes: (a) a first coupler configured to secure the first sight pin to the sight frame; (b) a second coupler configured to secure the second sight pin to the sight frame; (c) a first biasing member configured to be coupled to the first sight pin; and (d) a second biasing member configured to be coupled to the second sight pin.

The first biasing member is configured to generate a first force acting along the first axis, wherein the first force is great enough to: (a) secure the first sight pin in a selected one of the first vertical positions when the first coupler has been at least partially loosened; and (b) maintain the first sight pin in the selected one of the first vertical positions until the first sight pin is subject to a first adjustment force in addition to the first weight.

The second biasing member is configured to generate a second force acting along the second axis, wherein the second force being great enough to: (a) secure the second sight pin in a selected one of the second vertical positions when the second coupler has been at least partially loosened; and (b) maintain the second sight pin in the selected one of the second vertical positions until the second sight pin is subject to a second adjustment force in addition to the second weight.

Additional features and advantages of the present disclosure are described in, and will be apparent from, the following Brief Description of the Drawings and Detailed Description.

DETAILED DESCRIPTION

Figure 1:
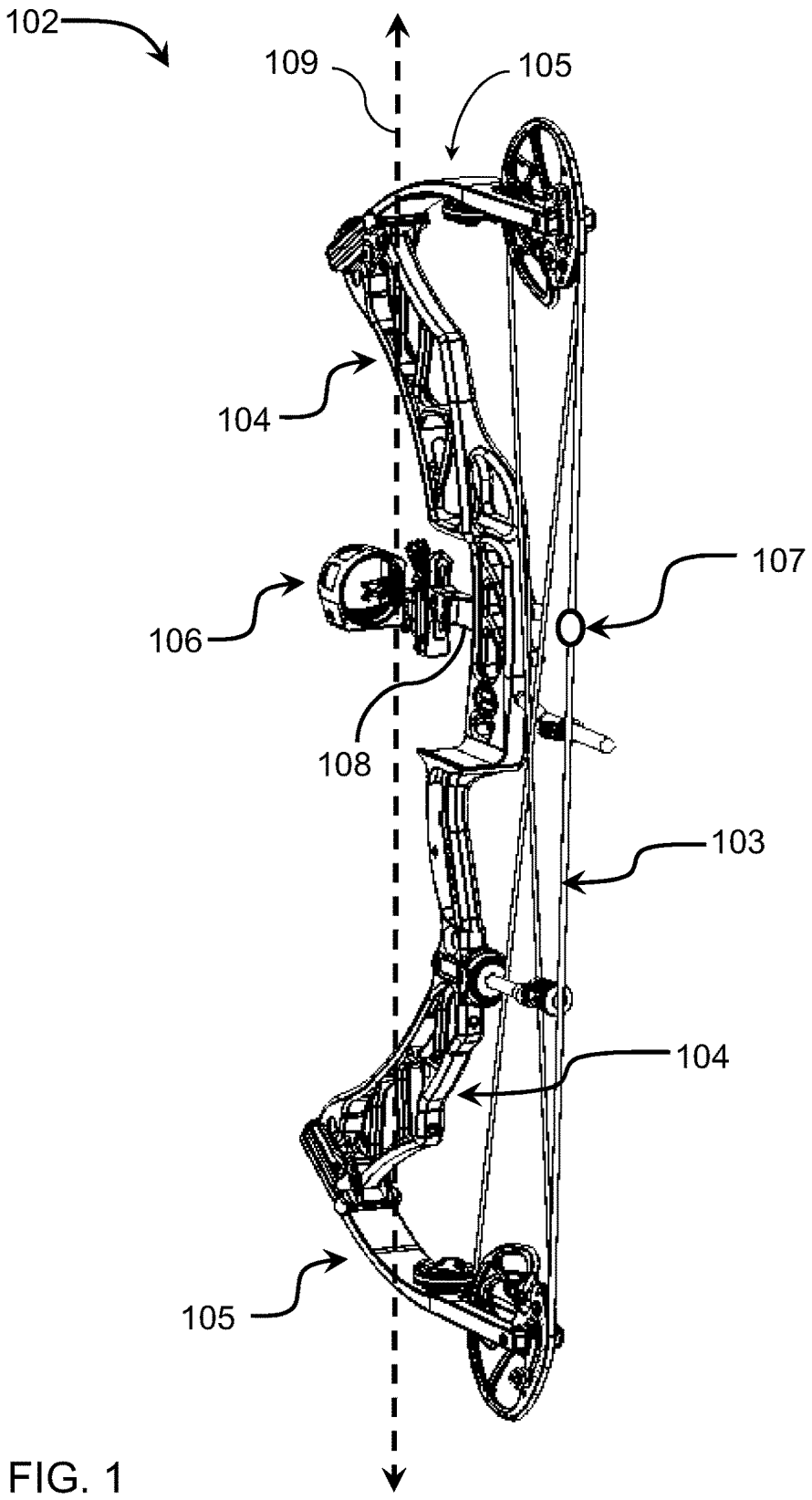
FIG. 1 is an isometric view of an embodiment of an archery bow and an archery sight mounted thereon.
Figure 2:
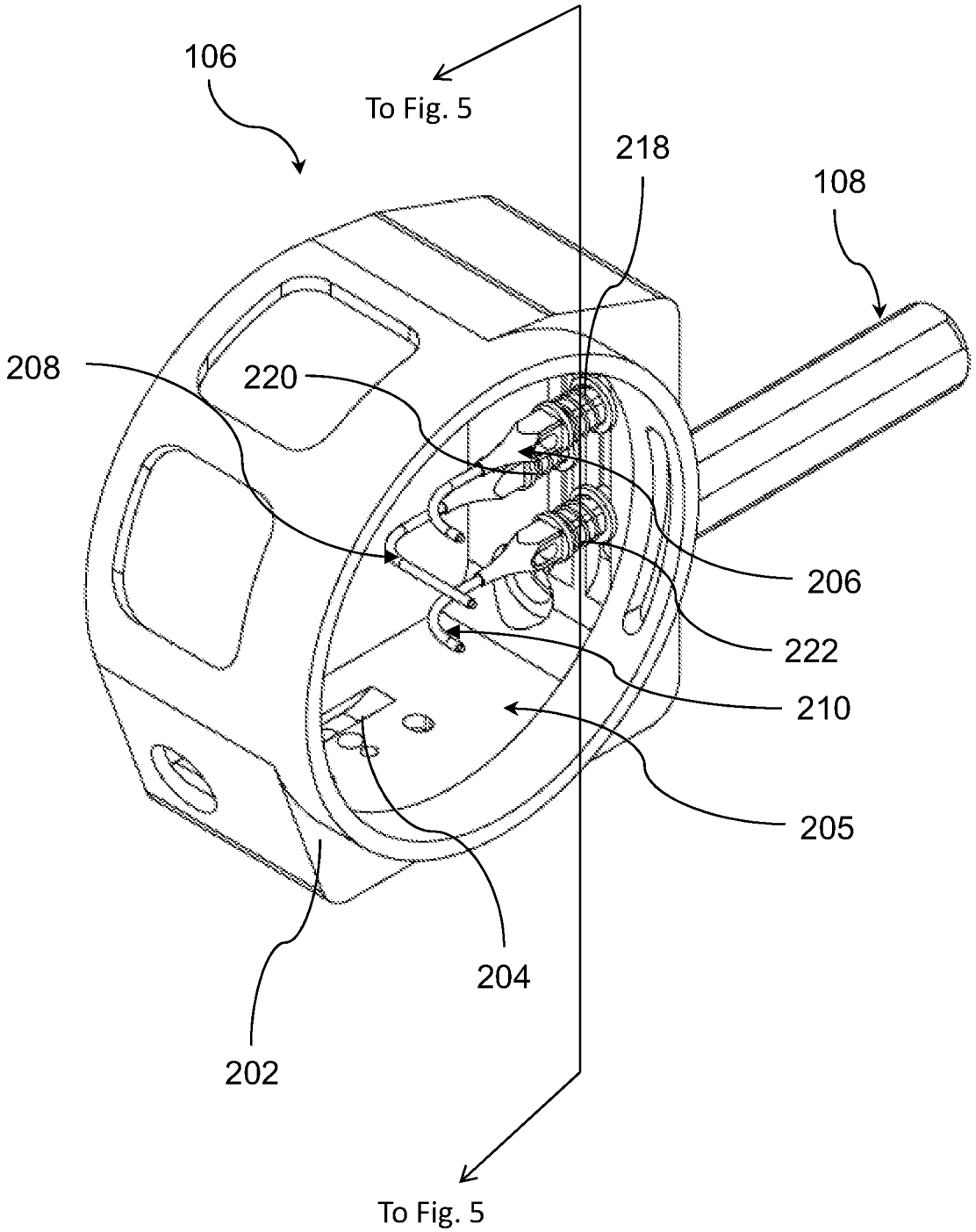
FIG. 2 is an isometric view of an embodiment of the archery sight of FIG. 1.

As illustrated in FIG. 1, in one embodiment, an archery bow 102 includes a bowstring 103 coupled to limbs 105. The limbs 105 are coupled to a riser 104. Bow sights 106 and 107 can be attached or coupled to the bow 102 through a mounting device 108 or other suitable coupler. In the illustrated example, the front bow sight 106 is mounted or attached to an attachment point on the riser 104 of the archery bow 102, and the peep or rear sight 107 is tied to, or interwoven with, the bowstring 103. In one embodiment, the rear sight 107 has a circular shape and a ring-like or disk-like structure, such as that of a flat washer.

As illustrated in FIGS. 2-5A, the mounting device 108 is coupled to the front bow sight 106 to attach or couple the bow sight 106 to the bow 102. The mounting device 108 can couple to a mounting point 110 (FIG. 4) of the bow sight 106. The mounting device 108 can couple to the mounting point 110 via a threaded coupling, a snap or press-fit, or any other suitable fit. Depending upon the embodiment, the mounting device 108 can include an arm, a bracket, a rod, a plate or any other suitable structure.

In one embodiment, the bow sight 106 includes a window, pin support, housing or frame 202. The frame 202 can be formed of metal, polymer, or any other suitable material. The frame 202 can have any suitable shape. For example, the frame 202 can be circular, semi-circular, rectangular, or a combination thereof, among others. In an embodiment shown in FIG. 3, the frame 202 forms a relatively thin shell around an interior space or pass-through opening 203 through which an archer can see. The frame 202 includes a mount 204 for coupling a level indicator (not shown) to the frame 202. The level indicator illustrates, shows or indicates the leveling of the bow relative to a vertical or horizontal plane. In an example, the level indicator mount 204 is situated on a bottom inside surface 205 of the frame 202.

Figure 5:
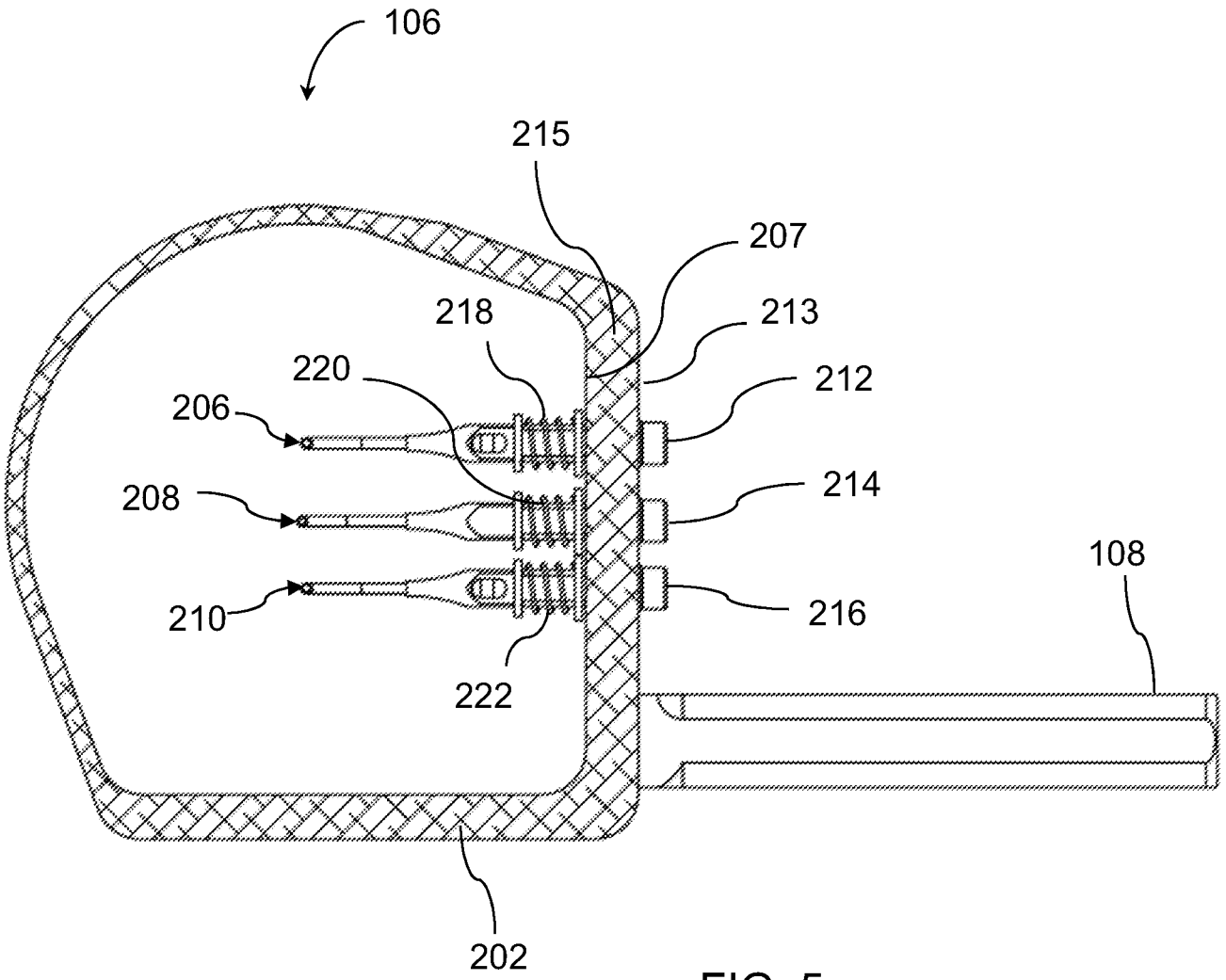
FIG. 5 is a cross-sectional view of the archery sight of FIG. 2 taken substantially along line 5-5 of FIG. 2
Figure 5A:
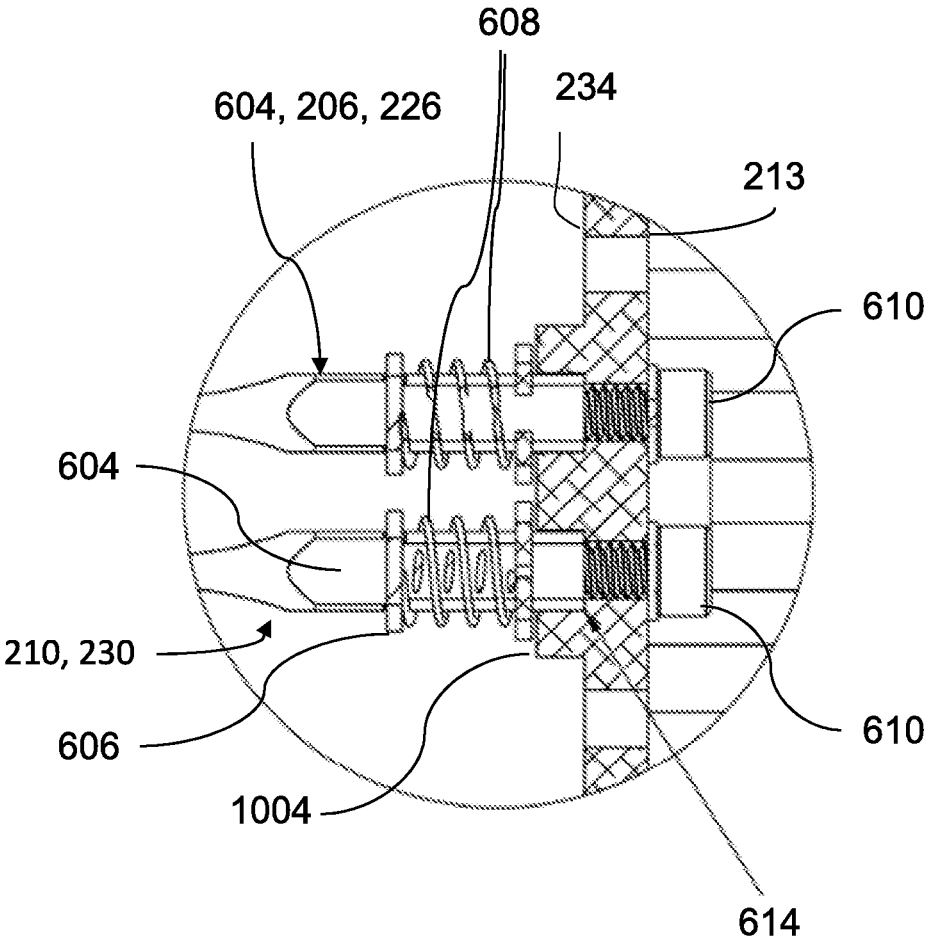
FIG. 5A is an enlarged, fragmentary, cross-sectional view of the archery sight of FIG. 2 taken substantially along line 5-5 of FIG. 2.
Figure 6:
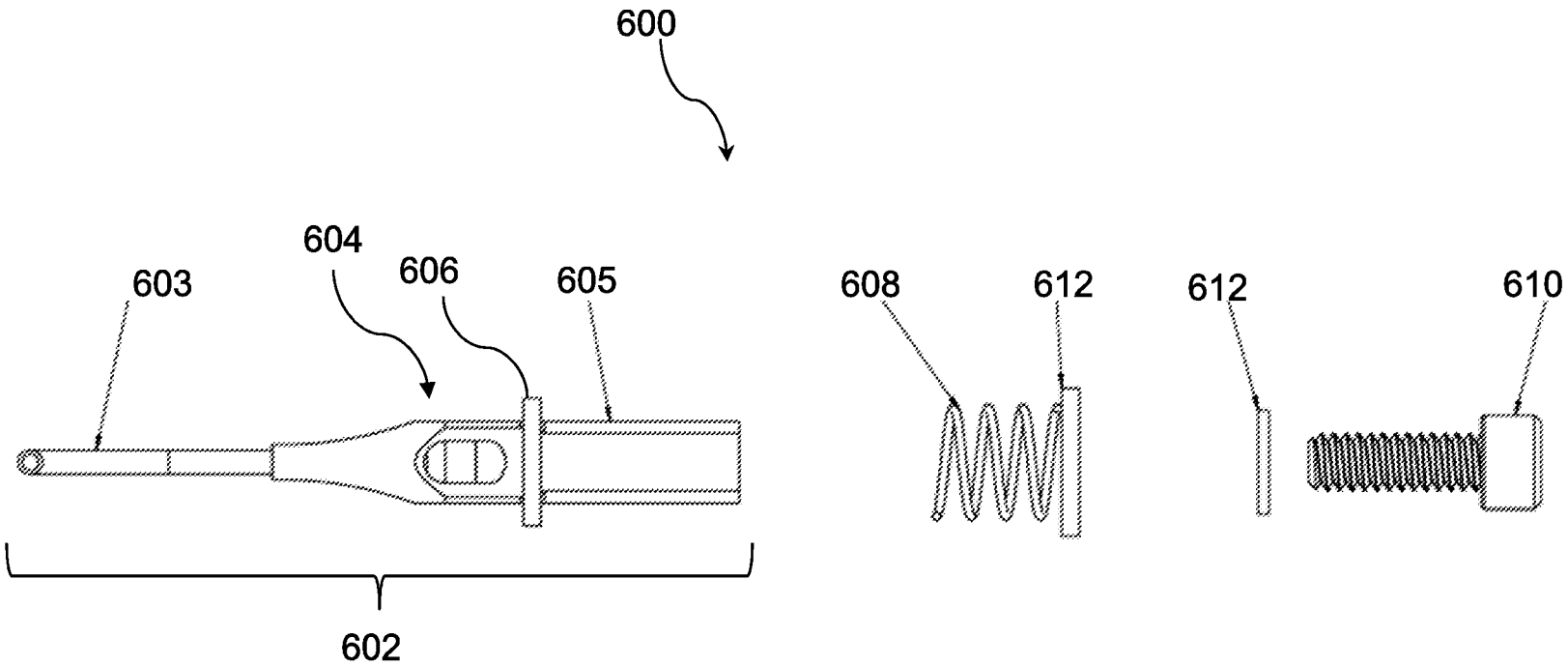
FIG. 6 is an exploded, front view of the sight pin and coupler of the archery sight of FIG. 2.

As illustrated in FIG. 5, the frame 202 includes a sight pin mounting surface 207 to which adjustable sight pins 206, 208, 210 are mounted. In an example, the frame 202 includes, supports, or houses a plurality of sight pins 206, 208, 210. The frame 202 can include or support any suitable number of sight pins 206, 208, 210. In an example, the sight pin mounting surface 207 includes or defines a plurality of elongated slots 209 and 211. Each slot 109, 211 extends vertically along or relative to vertical axis 109 (FIG. 1) when the frame 202 is coupled to the bow 102 and when the bow 102 is held or oriented vertically. Sight pins 206 and 210 are adjustably and moveably coupled to surface 207 within slot 211. Sight pin 208 is adjustably and moveably coupled to surface 207 within slot 209.

In an example, the mounting surface 207 includes a plurality of measurement marking strip or position settings (not shown) along the length of each slot 209, 211. These settings or markings indicate a distance, measurement, or positional information to assist the archer in tracking his/her repositioning of the sight pins 206, 208, 210. In another embodiment, each slot 209 and 211 includes a plurality of notches (not shown) positioned along the length of the respective slot 209, 211 for receiving the sight pins 206, 208, 210. In such an embodiment, each pin 206, 208, 210 has a protrusion or recess configured to mate with the associated notch. Mating a sight pin 206, 208, or 210 with a notch sets the position of the sight pin for use at the distance to which the notch corresponds.

The sight pins 206, 208, 210 are positioned on an inner surface of the sight pin mounting surface 207. A fastener or coupler 212, 214, 216 extends from an outer surface of the sight pin mounting surface 207, through the frame 202 to be received in each of the sight pins 206, 208, 210. Depending upon the embodiment, each coupler 212, 214, 216 can include a threaded screw with a screw head, a threaded bolt with a bolt head, a nut, a clip such as a C-clip or any other suitable securing member or locking member.

Each sight pin 206, 208, 210 includes a friction increaser, position retainer, position maintainer, biasing device or sight pin biasing member 218, 220, 222. The sight pin biasing members 218, 220, 222 generate forces that respectively force the sight pins 206, 208, 210 against the mounting surface 207 or that force the couplers 212, 214, 210 against the mounting surface 207. In one embodiment illustrated in FIG. 3, each sight pin biasing member 218, 220, 222 is operable to generate a tension force that pulls a sight body 226, 228, 230 in a first direction 232 away from the interior mounting surface 234 (FIG. 5A) so that the fastener or coupler 212, 214, 216 is pressed against the exterior mounting surface 213. In another embodiment not shown, the sight pin biasing members 218, 220, 222 are positioned between the exterior mounting surface 213 and the couplers 212, 214, 216, respectively. As such, the sight pin biasing members 218, 220, 222 are each operable to push the fastener or coupler 212, 214, 216 in a second direction (not shown) opposite of the first direction which, in turn, pulls the associated sight body 226, 228, 230 onto the interior mounting surface 234. In yet another embodiment not shown, each sight pin biasing member, which can include a clamp in one example, is operable to generate a compression force. In such embodiment, two parts of the sight pin sandwich the mounting surface 207, and the sight pin biasing member forces the two parts together so that they compress the mounting surface 207. Depending upon the embodiment, the sight pin biasing member of each sight pin can include or incorporate a spring (including, but not limited to, a coil spring or a leaf spring), a bushing, or an elastic or resilient element (including, but not limited to, a rubber or silicon block or pad).

Figure 3:
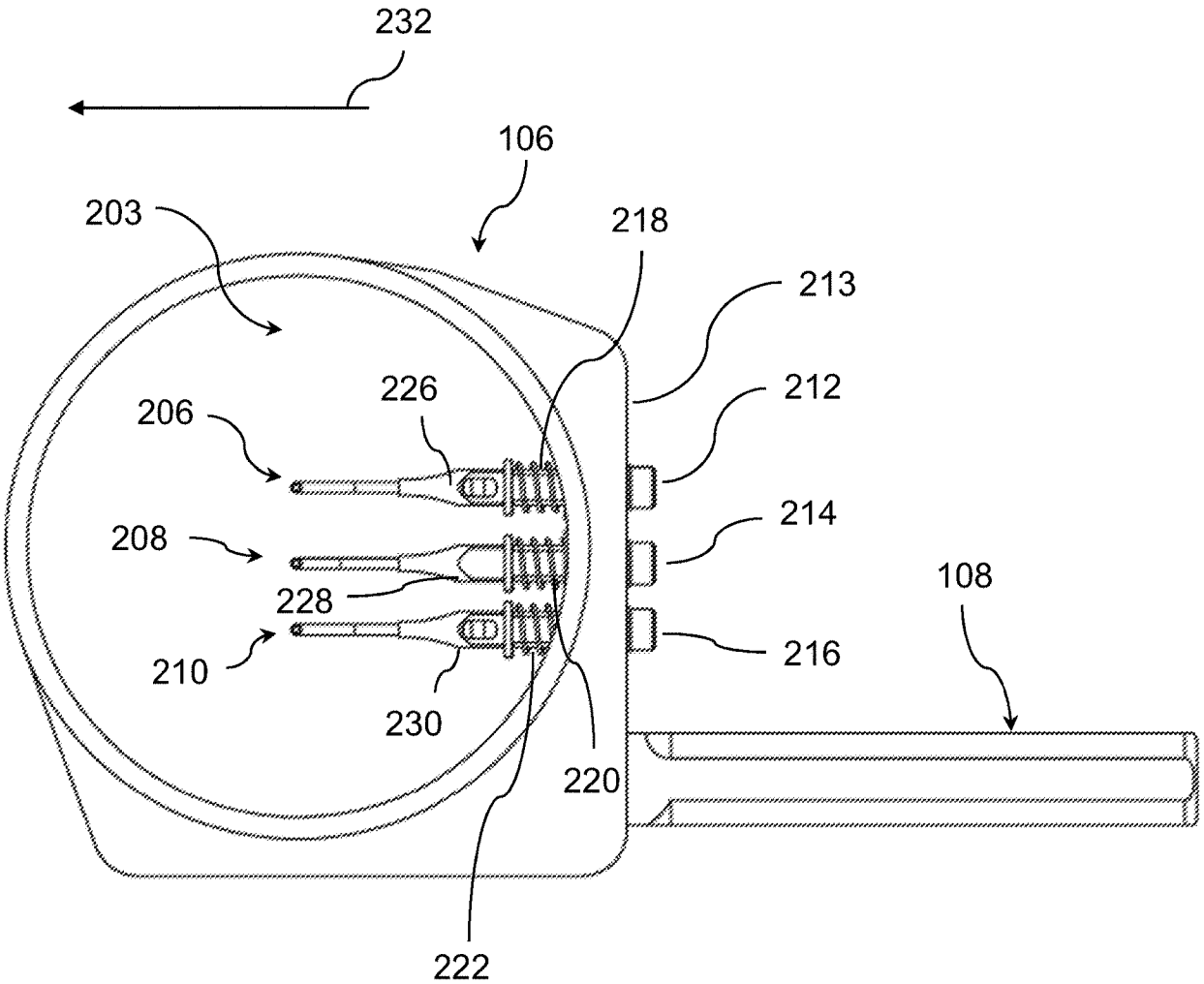
FIG. 3 is a front view of the archery sight of FIG. 2.

In the embodiment illustrated in FIGS. 3 and 5, the sight pin biasing devices or biasing members 218, 220, 222 are springs coupled to the sight pins 206, 208, 210, respectively, and such springs are in contact with the sight pin mounting surface 207. Sliding the springs 218, 220, 222 onto the sight pins 206, 208, 210 allows the sight pins 206, 208, 210 to be pre-loaded with a spring force. When the coupler 212, 214, 216 is tightened to achieve a secure mode, the corresponding sight pin 206, 208, 210 is held in position on the sight pin mounting surface 207, pinching the sight pin mounting surface 207 between the sight pin 206, 208, 210 and the head 212, 214, 216. Accordingly, the user can fix or secure the sight pins 206, 208, 210 in desired vertical positions along axis 109 (FIG. 1) by tightening couplers 212, 214, 216, resulting in the secure mode. When the couplers 212, 214, 216 are partially loosened to achieve an adjustment mode or loose mode, the weight of each sight pin 206, 208, 210 acts downward along axis 109. Without the sight pin biasing members 218, 220, 222, the weights of the pins 206, 208, 210 would cause the pins 206, 208, 210 to free-fall or drop downward to the bottom 236 (FIG. 4) of the associated slot 209, 211. This would create a significant disadvantage for users seeking to make minor, incremental or fine tuning vertical adjustments to the pins 206, 208, 210.

Figure 3A:
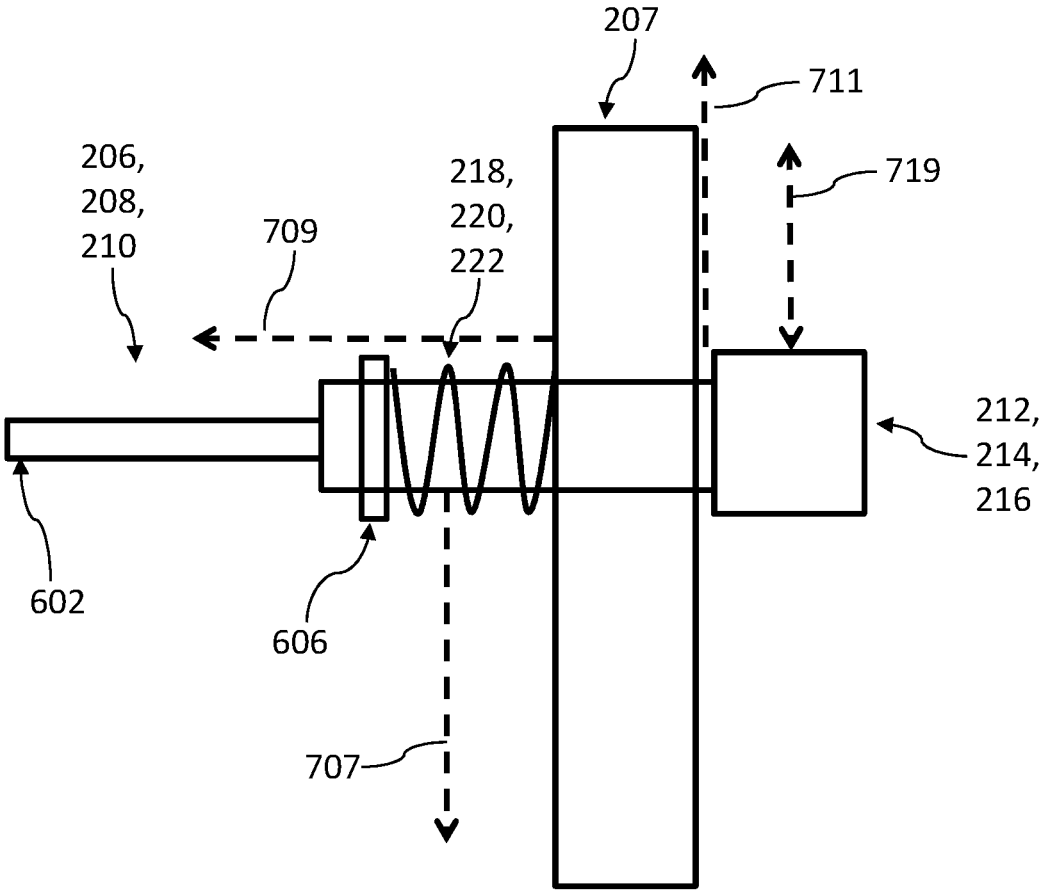
FIG. 3A is a schematic, front view of an embodiment of the archery sight, illustrating a first force diagram.
Figure 3B:
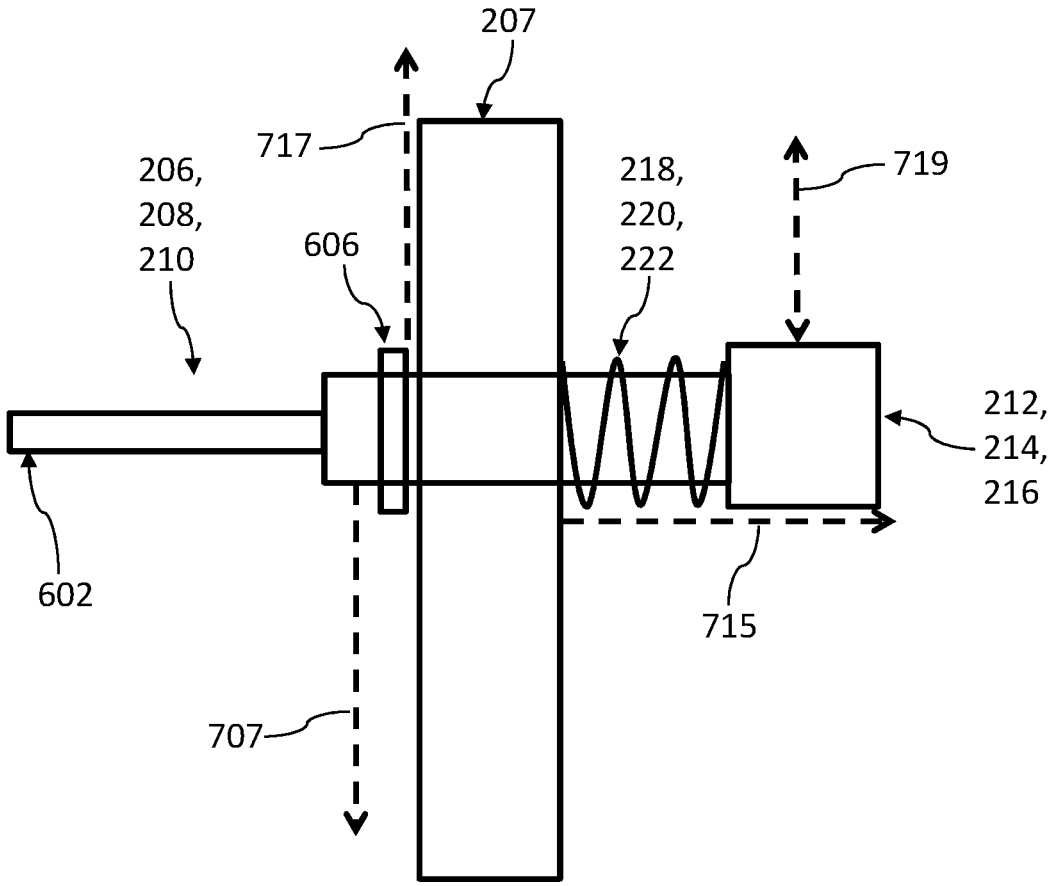
FIG. 3B is a schematic, front view of another embodiment of the archery sight, illustrating a second force diagram.

The biasing devices or biasing members 218, 220, 222 overcome this disadvantage. In an embodiment illustrated in FIG. 3A in the adjustment mode or loose mode, each pin 206, 208, 210 has a weight force or a weight 707 acting downward. Also, each biasing member 218, 220, 222 generates a biasing force 709 which increases the frictional force 711 between the mounting surface 207 and the associated coupler 212, 214, 216. In another embodiment illustrated in FIG. 3B, each biasing member 218, 220, 222 generates a biasing force 715 which increases the frictional force 717 between the mounting surface 207 and the collar 606 of the associated pin 206, 208, 210. In each of these embodiments, the biasing force 709, 715 in the loose mode is less than the securing force caused by the tightened coupler 212, 214, 216 in the secure mode. However, the frictional force 711, 717 caused by the biasing force 709, 715, is equal to or greater than the weight 707. Consequently, without any hand force 719 from the user, the biasing force 709, 715 prevents the pin 206, 208, 210 from dropping or sliding downward. To adjust the pin 206, 208, 210, the user can apply his/her manual hand force 719 which, when combined with the weight 707, causes the pin 206, 208, 210 to gradually slide to the desired vertical position, overcoming the frictional force 711, 717. If, during the adjustment mode, the user periodically releases the pin 206, 208, 210, the biasing force 709, 715 keeps the pin 206, 208, 210 from falling. Depending upon the embodiment, the biasing force 709, 715 can act in the first direction 232 (FIGS. 3 and 3A) or in a second direction opposite of the first direction 232, as illustrated in FIG. 3B. The frictional force 711, 717 acts upward along the vertical axis 109 (FIG. 1), and the user's hand force 719 can act upward or downward along axis 109.

In an embodiment, each biasing member 218, 220, 222 generates tension against the mounting surface 207 which prevents the sight pins 206, 208, 210 from dropping out of position and allows for easier and finer adjustment of the sight pin 206, 208, 210. These finer adjustments render the bow sight 106 more accurate to the archer. In the embodiment shown, the coupler 212, 214, 216 is a separate component from the pin body 226, 228, 230. In one embodiment not shown, the coupler 212, 214, 216 is integral with the pin body 226, 228, 230, a portion of the pin body 226, 228, 230 is threaded, and the pin receiving walls 215 of the mounting surface 207 are threaded.

Referring to FIGS. 3-5A, in operation of one example, the user inserts the pin body 226 of the sight pin 206 into the associated slot 211 defined by mounting surface 207. Next, the user uses a tool, such as a wrench, to partially screw the head 238 of coupler 212 into the pin body 226 to sandwich the pin receiving wall 215 of the mounting surface 207. At this point, the sight pin 206 is not tightly screwed onto the mounting surface 207. Were it not for the sight pin biasing member 218, the sight pin 206 would free-fall and slide downward due its weight 707 (FIGS. 3A-3B) based on gravity. However, the sight pin biasing member 218 urges the coupler 212 against the mounting surface 207. Since the coupler 212 is connected to the sight pin 206, this urging force 709, 715 (FIGS. 3A-3B) prevents the sight pin 206 from free-falling while the bow sight 106 is in the loose mode or adjustment mode. During the loose or adjustment mode, the user uses his/her fingers and/or tool to sensitively slide the sight pin 206 upward or downward along axis 109 (FIG. 1). This enables the user to select between a plurality of vertical positions along the axis 109. When reaching the desired vertical position, the user releases the sight pin 206, and the sight pin biasing member 218 maintains the sight pin 206 at the desired vertical position. Finally, the user uses a tool, such as a wrench, to fully tighten the coupler 212 until the sight pin 206 is fully screwed onto the mounting surface 207, achieving a secure mode. This tightening generates a securing force which locks the sight pin 206 in position and transitions the bow sight 106 from the loose or adjustment mode to the secure or shooting mode. Whenever the user finds the need to adjust the position of the sight pin 206 again, the user can repeat the foregoing steps with convenience and efficiency. After setting the vertical positions of the sight pins 206, 208, 210 according to the method described above, the user can pull back the bowstring 103. The user looks through the rear sight 107 and aligns it with a desired one of the sight pins 206, 208, 210. Then, the user aims at the target and releases the bowstring 103, which shoots the arrow forward.

As illustrated in FIGS. 2-9, in an embodiment, a sight pin assembly 600 includes a sight pin 602. The sight pin 602 has a weight 707 (FIGS. 3A-3B), and sight pin 602 includes: (a) a tip portion or sighting end 603; (b) a sight base or sight pin body 604; and (c) a mount portion or fastening end 605. The sighting end 603 can be of any suitable shape. For example, the sighting end 603 can be a hooked or conical shape such that the sighting end 603 comes to a small point. This sighting end 603 is placed on the target during operation of the bow sight 106. The sight pin body 604 includes a ridge or collar 606 encircling the sight pin body 604. A biasing member 608, such as a coil spring, is positioned around the sight pin body 604 and resting against the collar 606. A coupler 610 is received in the fastening end 605.

Figure 7:
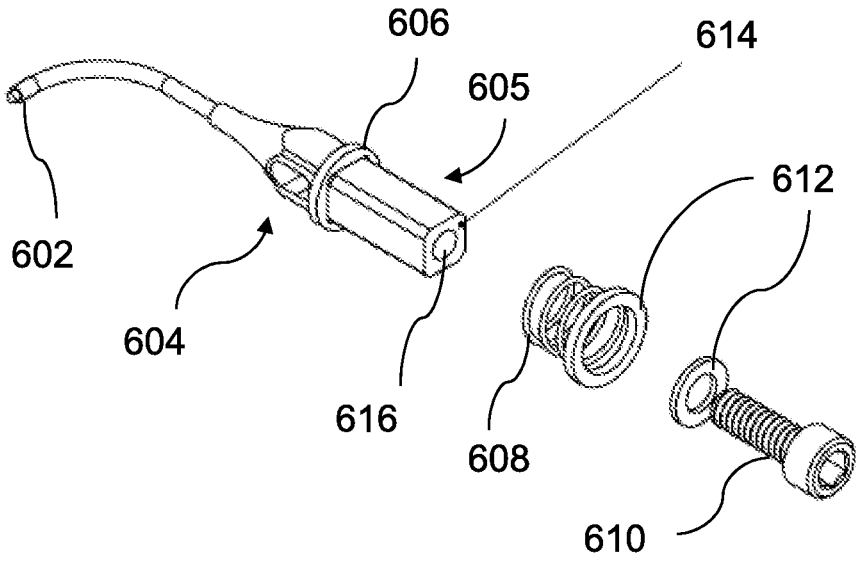
FIG. 7 is an exploded isometric view of the sight pin and coupler of FIG. 6.
Figure 8:
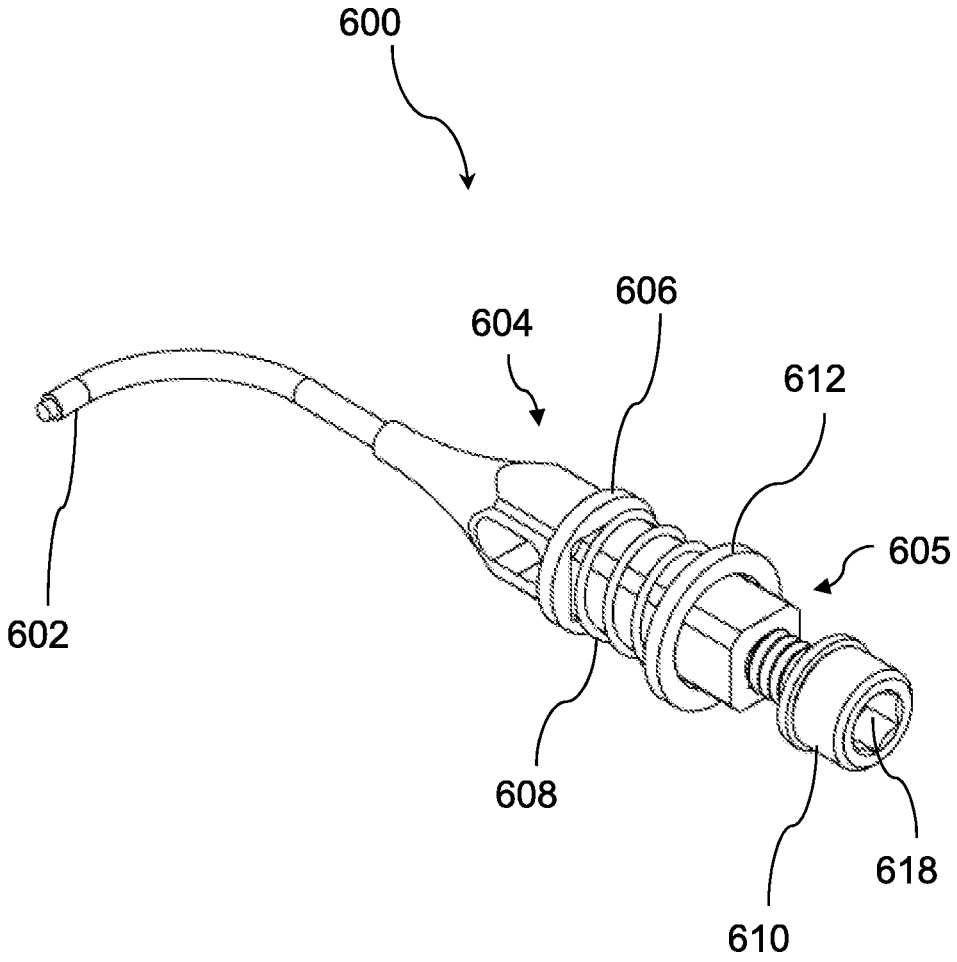
FIG. 8 is an enlarged, isometric view of the sight pin and coupler of FIG. 6.
Figure 9:
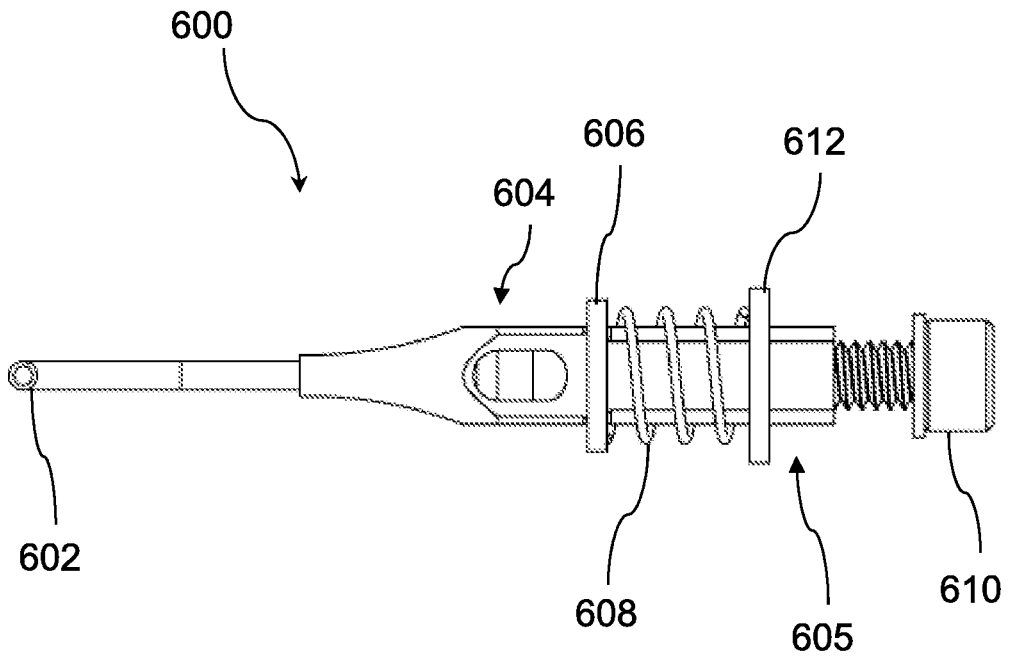
FIG. 9 is a front elevation view of the sight pin and coupler of FIG. 6.
Figure 10:
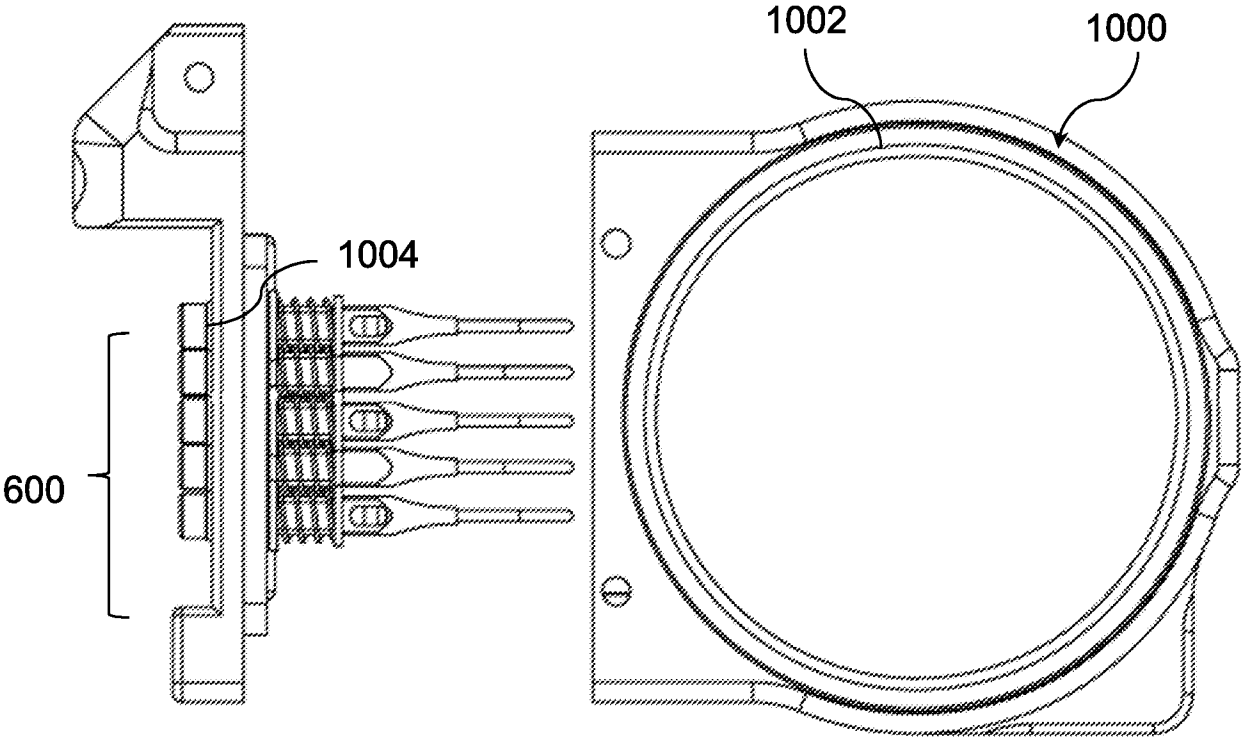
FIG. 10 is an exploded rear view of an embodiment of an archery sight illustrating an example of five adjustable sight pins.
Figure 11:
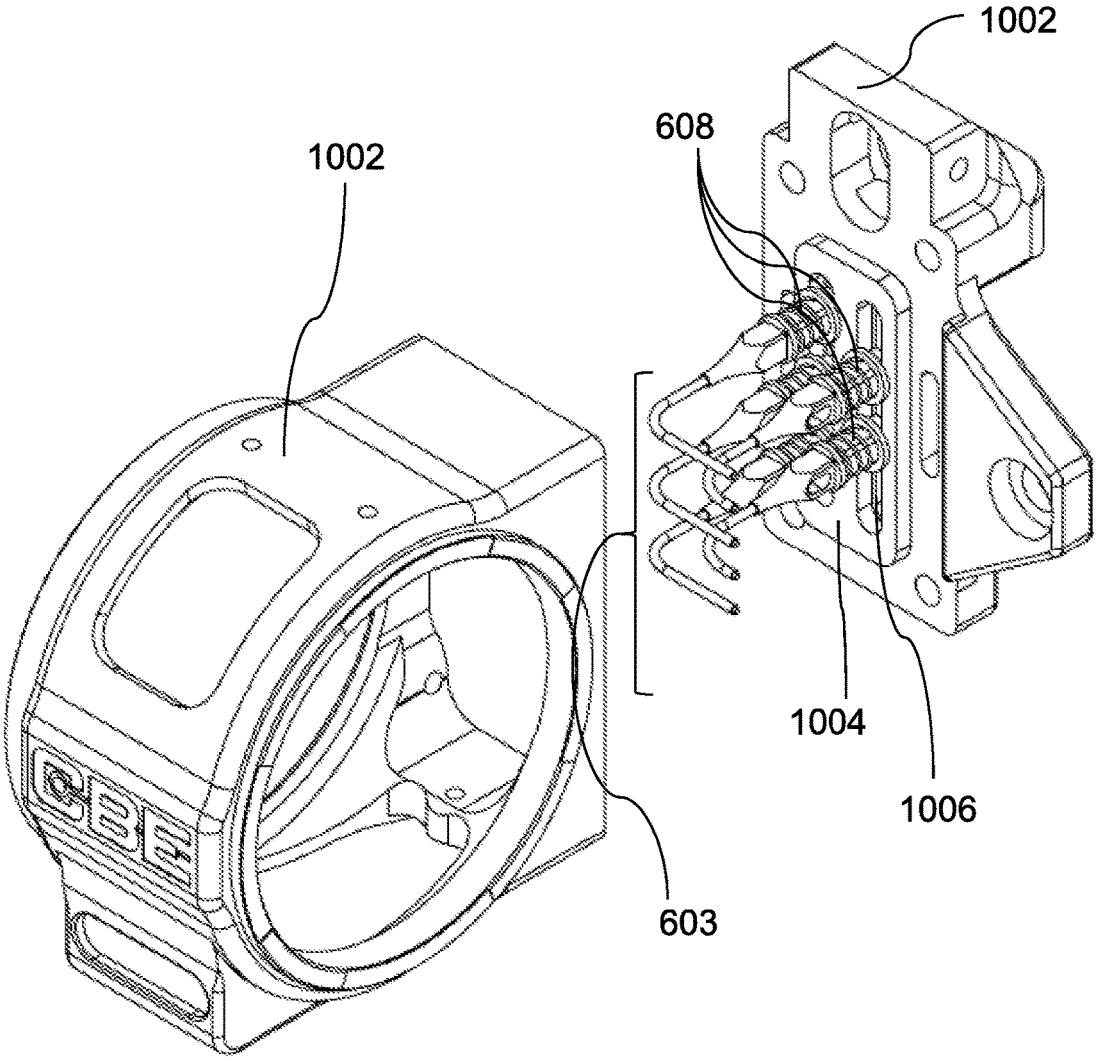
FIG. 11 is an exploded isometric view of the archery sight of FIG. 10.
Figure 12:
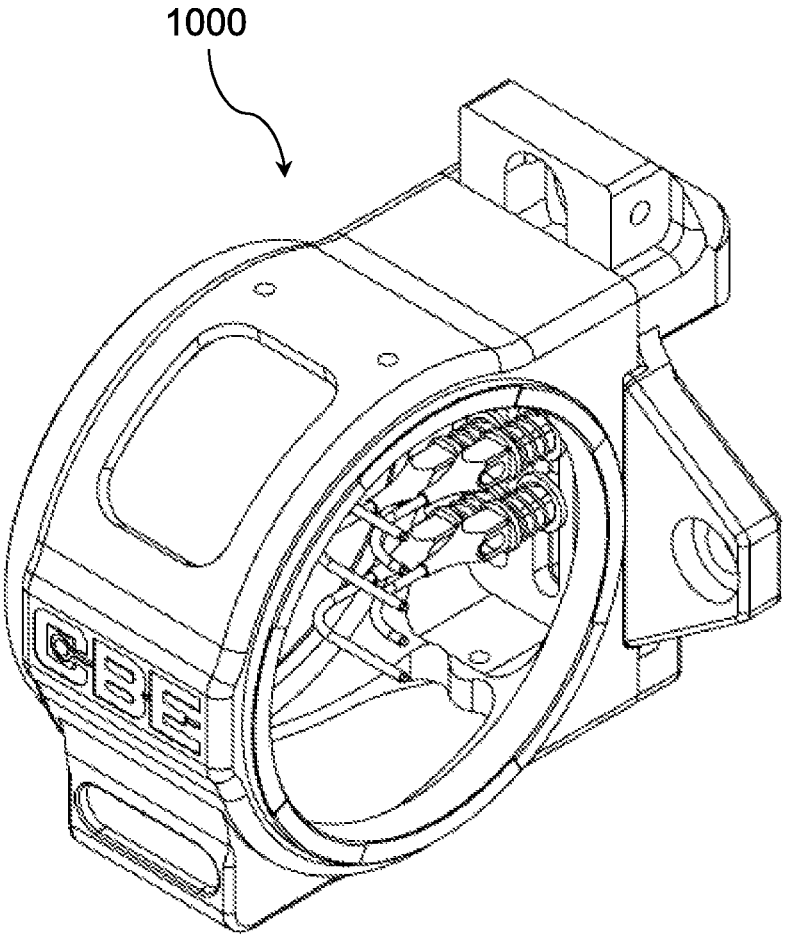
FIG. 12 is an isometric view of the archery sight of FIG. 10.
Figure 13:
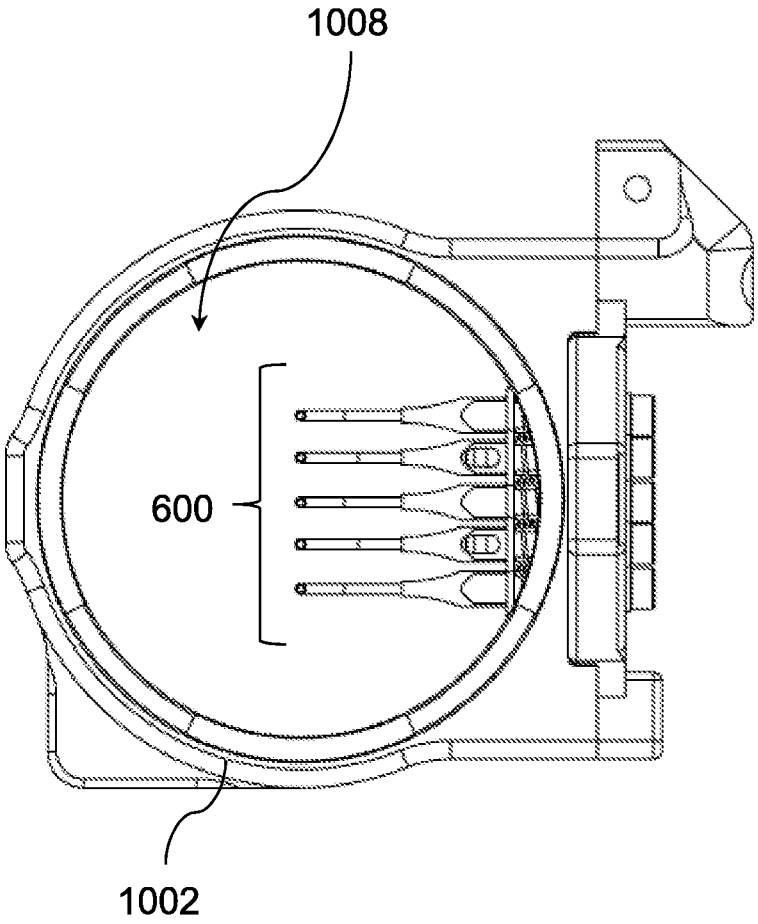
FIG. 13 is a front view of the archery sight of FIG. 10.

As illustrated in FIG. 7, the fastening end 605 includes a locking surface 614 in which a receiving surface 616 is positioned. In an example, the receiving surface 616 is a cavity, such as a threaded hole, for receiving a coupler 610. The coupler 610 can be any suitable type of fastener. For example, the coupler 610 is a threaded screw for engaging the threaded receiving surface 616. In order to prevent unintentional operation or loosening of the coupler 610, the coupler 610 can include a key pattern 618 (FIG. 8). The key pattern 618 corresponds to a key device (not shown), such as an Allen wrench. In this embodiment, the coupler 610 can only be loosened or tightened with the corresponding key device. A ring or washer, or plurality of rings or washers, 612 can be positioned between the sight pin body 604 and the coupler 610.

In an embodiment illustrated in FIGS. 10-13, the sight pin assembly 600 is coupled to a sight pin coupling surface 1004 of the housing or frame 1002 of a bow sight 1000. The sighting end 603 of the sight pins 602 extend into an opening 1008 in the frame 1002. The locking surface 614 of the sight pin base 604 contacts the inner surface of the sight pin coupling surface 1004. The coupler 610 extends from an outer surface of the sight pin coupling surface 1004, through the sight pin coupling surface 1004, to be received in the sight bin body 604. The biasing member 608 is positioned between the collar 606 of the sight pin body 604 and the inner surface of the sight pin attachment surface 1004. Tension generated by the biasing member 608 urges the coupler 610 against the sight pin attachment surface 1004 which prevents the sight pin assembly 600 from unintentionally moving out of position or free-falling when the fastener 610 is at least partially loosened.

Each of the sight pins 600 can be colored to distinguish the distance indicated by the sight pin 600. In an example, these colors can include colored paint or materials, colored lights, such as electrically-powered LED lights, or phosphor-based or glowing materials, to distinguish the sight pins from each other in low lighting conditions. In another example, the bow sight 1000 can include a sight light (not shown) for illuminating the sighted area. In an example, the sight light is an LED light.

Figure 4:
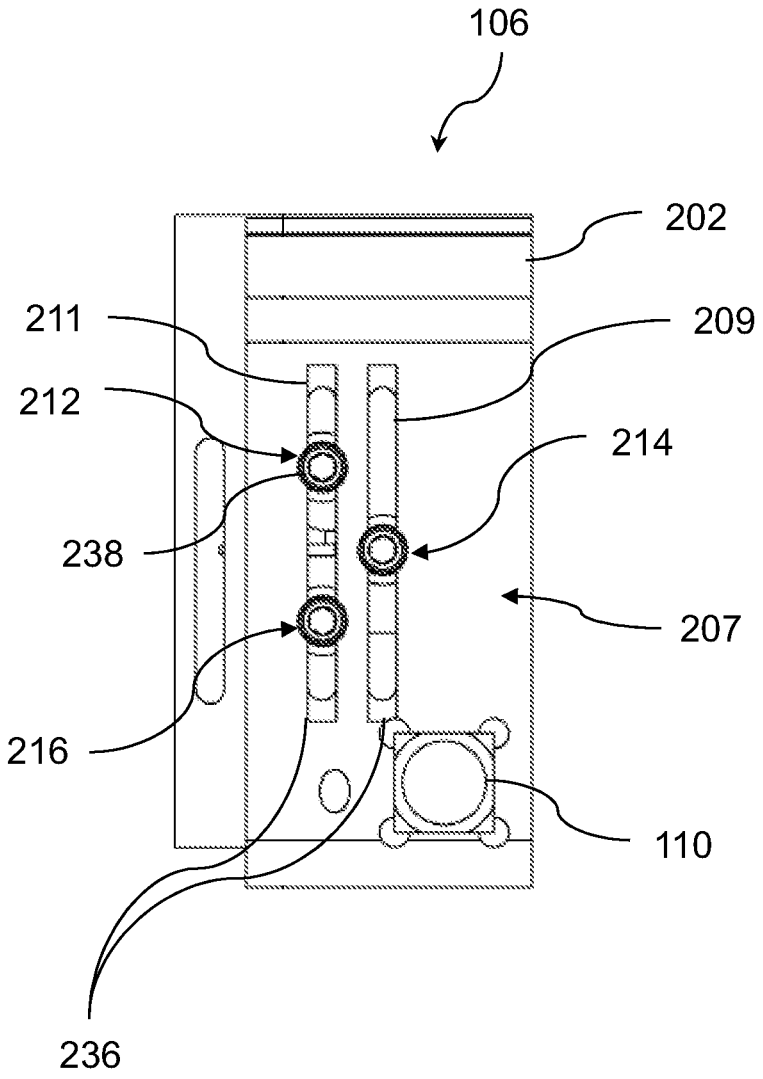
FIG. 4 is a right side elevation view of the archery sight of FIG. 2
Figure 14:
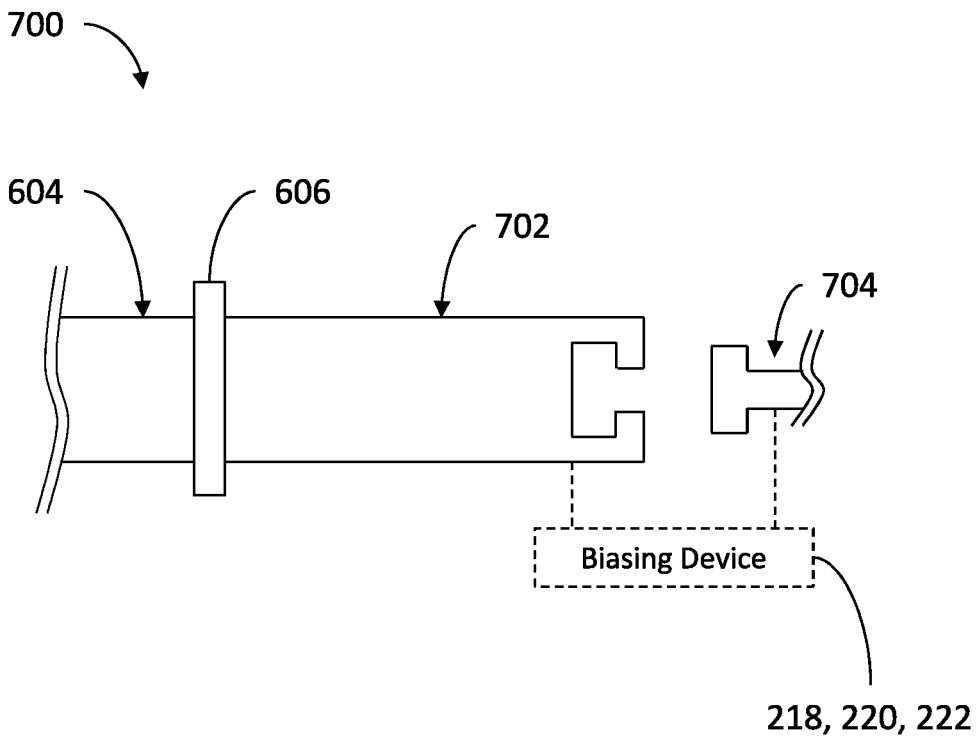
FIG. 14 is a schematic, front view of an embodiment of the archery sight, illustrating a sight pin mount portion configured to receive a track of a frame.

Referring to FIG. 14, in an embodiment, the pin sight 700 has the same structure, components and functionality as pin sight 602 except that: (a) mount portion 605 is replaced with mount portion 702; and (b) mounting surface 207 defines a peak, protrusion or track 704 instead of a slot 211 (FIG. 4). In this example, mount portion 702 defines a slot, such as a partial I-shaped slot configured to receive and mate with, the track 704. Accordingly, the pin sight 700 is configured to be vertically adjusted along the axis 109 (FIG. 1) by sliding along the track 704.

In another embodiment, the bow sight 106 comprises a magnetic device instead of the sight pin biasing member. In an example, the magnetic device is incorporated into a sight pin 206, 208, 210 or a coupler 212, 214, 216. When the user has loosened a coupler 212, for example, the magnetism of the magnetic device prevents the sight pin 206 from free-falling under its own weight 707 (FIGS. 3A-3B). This enables the user to gradually, manually slide the sight pin 206 upward or downward, overcoming the magnetic force until reaching a desired vertical position.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A bow sight comprising:

a frame configured to be coupled to an archery bow, the frame defining a slot configured to extend vertically when the frame is coupled to the archery bow and when the archer bow is vertically oriented;

at least one sight pin comprising:

a weight;

a mount portion configured to be at least partially inserted into the slot; and a tip portion, the mount portion configured to be adjustable between a plurality of vertical positions within the slot; and at least one coupler configured to couple the mount portion to the frame, wherein the at least one coupler is configured to be adjusted between:

a secure mode in which the mount portion is secured in one of the vertical positions; and a loose mode in which the weight of the at least one sight pin is sufficient to move the mount portion to another one of the vertical positions; and a biasing member configured to be coupled to the mount portion, wherein the biasing member is configured to counteract the weight of the sight pin to maintain the sight pin in one of the vertical positions when the at least one coupler is in the loose mode.

2. The bow sight of claim 1, wherein:

the at least one coupler is configured to generate a securing force; and the biasing member is configured to generate a biasing force which is less than the securing force, enabling the sight pin to be manually moved between the vertical positions during the loose mode while the biasing force is applied.

3. The bow sight of claim 1, wherein the biasing member comprises a device selected from the group consisting of a spring, a coil spring, a leaf spring, a bushing and an elastic element.

4. The bow sight of claim 1, wherein:

the sight pin comprises a pin body between the mount portion and the tip portion; and the at least one coupler is configured to at least partially extend through the slot to be coupled to the mount portion.

5. The bow sight of claim 4, further comprising a collar encircling the pin body, wherein the biasing member is configured to push the collar, causing the at least one coupler to be pulled toward the frame.

6. A bow sight comprising:

a sight frame comprising at least one pin mounting surface extending vertically when the sight frame is coupled to an archery bow which is oriented held vertically, the at least one mounting surface comprising at least one track extending vertically when the sight frame is coupled to the archery bow oriented vertically;

at least one sight pin configured to be coupled to the at least one track and movable between a plurality of vertical positions relative to the at least one track, the at least one sight pin comprising:

a weight;

a sighting end;

a fastening end configured to be adjustably coupled to the at least one track; and a pin body extending between the sighting end and the fastening end;

a pin fastener configured to fasten the fastening end to the at least one track;

a biasing member configured to be coupled to the at least one sight pin, wherein the biasing member is configured to generate a force to maintain the at least one sight pin in a first one of the vertical positions when the pin fastener has been loosened, wherein the force is sufficient to maintain the first position until the at least one sight pin is subject to another force in addition to the weight of the at least one sight pin.

7. The bow sight of claim 6, wherein the biasing member comprises a spring.

8. The bow sight of claim 6, wherein the biasing member comprises a device selected from the group consisting of a coil spring, a leaf spring, a bushing, and an elastic element.

9. The bow sight of claim 6, wherein the pin body comprises a collar.

10. The bow sight of claim 9, wherein the biasing member is configured to push the collar, causing the pin fastener to be pulled toward the sight frame.

11. The bow sight of claim 6, wherein:

the at least one fastener comprises a head;

the biasing member comprises: (a) a first end configured to engage the sight frame; and (b) a second end configured to engage the head; and the biasing member is configured to be positioned between the sight frame and the head to push the head away from the sight frame.

12. The bow sight of claim 6, wherein the track defines a slot configured to at least partially receive the fastening end.

13. The bow sight of claim 6, wherein the track comprises a rail configured to be inserted into a slot defined by the fastening end.

14. The bow sight of claim 6, wherein the force of the biasing member is configured to increase a frictional engagement of the at least one sight pin with the sight frame.

15. A bow sight comprising:

a sight frame configured to be coupled to an archery bow, the sight frame comprising at least one pin mounting surface, the sight frame defining:

first and second slots, each of the first and second slots extending vertically when the sight frame is coupled to an archery bow which is vertically oriented;

a first sight pin configured to be coupled to the sight frame, the first sight pin being moveable between a plurality of first vertical positions relative to the first slot, the first sight pin being associated with a first shooting distance, the first sight pin comprising a first weight and a first insert configured to be inserted into the first slot, the first insert extending along a first axis;

a second sight pin configured to be coupled to the sight frame, the second sight pin being moveable between a plurality of second vertical positions relative to the second slot, the second sight pin being associated with a second shooting distance which is different from the first shooting distance, the second sight pin comprising a second weight and a second insert configured to be inserted into the second slot, the second insert extending along a second axis;

a first coupler configured to secure the first sight pin to the sight frame;

a second coupler configured to secure the second sight pin to the sight frame;

a first biasing member configured to be coupled to the first sight pin;

a second biasing member configured to be coupled to the second sight pin, wherein the first biasing member is configured to generate a first force acting along the first axis, the first force being great enough to:

(a) secure the first sight pin in a selected one of the first vertical positions when the first coupler has been at least partially loosened; and (b) maintain the first sight pin in the selected one of the first vertical positions until the first sight pin is subject to a first adjustment force in addition to the first weight, wherein the second biasing member is configured to generate a second force acting along the second axis, the second force being great enough to:

(a) secure the second sight pin in a selected one of the second vertical positions when the second coupler has been at least partially loosened; and (b) maintain the second sight pin in the selected one of the second vertical positions until the second sight pin is subject to a second adjustment force in addition to the second weight.

16. The bow sight of claim 15, wherein:

the first sight pin comprises a first pin body and a first tip, the first pin body extending between the first tip and the first insert; and the first sight pin comprises a second pin body and a second tip, the second pin body extending between the second tip and the second insert.

17. The bow sight of claim 16, wherein at least one of the first and second couplers comprises a screw.

18. The bow sight of claim 16, wherein at least one of the first and second biasing members comprises a device selected from the group consisting of a coil spring, a leaf spring, a bushing, and an elastic element.

19. The bow sight of claim 15, further comprising a mounting device configured to couple the bow sight to the archery bow.

20. A bow assembly comprising:

the bow sight of claim 15; and a mounting device which couples the bow sight to the archery bow, wherein the archery bow comprises:

a bow riser;

a plurality of limbs coupled to the bow riser; and a bowstring coupled to the limbs.

* * * * *